US011523952B2

(12) United States Patent
Lee et al.

(10) Patent No.: US 11,523,952 B2
(45) Date of Patent: Dec. 13, 2022

(54) INPUT DEVICES FOR CONTROLLING A WHEELCHAIR

(71) Applicant: Toyota Motor North America, Inc., Plano, TX (US)

(72) Inventors: Christopher Lee, Little Elm, TX (US); Douglas A. Moore, Fairview, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 635 days.

(21) Appl. No.: 16/570,114

(22) Filed: Sep. 13, 2019

(65) Prior Publication Data

US 2021/0077323 A1 Mar. 18, 2021

(51) Int. Cl.
*A61G 5/10* (2006.01)
*A61G 5/04* (2013.01)

(52) U.S. Cl.
CPC ..... *A61G 5/1051* (2016.11); *A61G 5/04* (2013.01); *A61G 5/1056* (2013.01); *A61G 2203/14* (2013.01); *A61G 2203/16* (2013.01)

(58) Field of Classification Search
None
See application file for complete search history.

(56) References Cited

U.S. PATENT DOCUMENTS 6,948,398 B2 9/2005 Dybro
7,155,034 B1 12/2006 Recce
9,348,334 B2 5/2016 McGinn et al.
2010/0331081 A1* 12/2010 Holenweg ..... A61G 5/1094 463/30
2018/0056985 A1* 3/2018 Coulter ..... B62K 5/007
2018/0203522 A1* 7/2018 Stucki ..... B60L 50/60
2018/0221226 A1 8/2018 Moore et al.
2019/0228465 A1 7/2019 Moore

FOREIGN PATENT DOCUMENTS

JP 2001138276 A 5/2001
JP 5229068 B2 7/2013
WO WO-2010150933 A1 * 12/2010 ..... B60K 37/06

* cited by examiner

*Primary Examiner* — Vicky A Johnson
(74) *Attorney, Agent, or Firm* — Dinsmore & Shohl LLP

(57) ABSTRACT

A system for controlling a wheelchair is disclosed. The system includes an input device that includes a shaft element, a base element, and one or more annular elements. A lower distal end of the shaft element is coupled to the base element, and the shaft element is configured to pivotally move about the lower distal end of the shaft element. A first annular element of the one or more annular elements is circumferentially disposed around the shaft element. The first annular element is coupled to the base element, and the first annular element is configured to rotate about the shaft element. The input device is configured to generate one or more input signals based on a position of the first annular element and a pivotal movement of the shaft element. The one or more input signals are configured to cause a controller to set an operation mode of the wheelchair.

18 Claims, 11 Drawing Sheets

INPUT DEVICES FOR CONTROLLING A WHEELCHAIR

FIELD

The present specification generally relates to input devices, and more particularly, to input devices that enable a user to control the operation mode and operational characteristics of the wheelchair.

BACKGROUND

A wheelchair enables a user to move from one location to another location while the user is positioned in a seat or base portion of the wheelchair. Accordingly, wheelchairs may be utilized when walking is difficult or impossible for a user due to, for example, illness, injury, or disability.

Wheelchairs may include input devices that enable a user to control the operation of the wheelchair. For example, the input devices may include a variety of input elements, such as buttons, switches, levers, and/or graphical user interfaces that enable a user to control the operation of the wheelchair. However, the controllers of the wheelchair may make it difficult for the user to readily and easily control the operation of the wheelchair. As such, a user of the wheelchair may not be able to control the operation of the wheelchair and, in some instances, may increase the likelihood of a collision and/or injury by not being able to readily control the operation of the wheelchair.

Accordingly, there is a need for an input device of a wheelchair that enables a user to easily and readily control the operation of the wheelchair.

SUMMARY

In one embodiment, a system for controlling a wheelchair is disclosed. The wheelchair includes an input device that includes a shaft element, a base element, and one or more annular elements. A lower distal end of the shaft element is coupled to the base element, and the shaft element is configured to pivotally move about the lower distal end of the shaft element. A first annular element of the one or more annular elements is circumferentially disposed around the shaft element. The first annular element is coupled to the base element, and the first annular element is configured to rotate about the shaft element. The input device is configured to generate one or more input signals based on a position of the first annular element and a pivotal movement of the shaft element. The one or more input signals are configured to cause a controller communicatively coupled to the input device to set an operation mode of the wheelchair.

In another embodiment, a system for controlling a wheelchair is disclosed and includes an input device that includes a shaft element, a base element, and one or more annular elements. A lower distal end of the shaft element is coupled to the base element, and the shaft element is configured to pivotally move about the lower distal end of the shaft element. A first annular element of the one or more annular elements is configured to rotate in response to an interaction with the first annular element. The input device is configured to generate one or more input signals based on a position of the first annular element and a pivotal movement of the shaft element. The one or more input signals are configured to cause a controller communicatively coupled to the shaft element and the one or more annular elements to set an operation mode of the wheelchair.

In yet another embodiment, a system is disclosed and includes a wheelchair and an input device. The input device includes a shaft element, a base element, and one or more annular elements. A lower distal end of the shaft element is coupled to the base element, and the shaft element is configured to pivotally move about the lower distal end of the shaft element. A first annular element of the one or more annular elements is circumferentially disposed around the shaft element. The first annular element is coupled to the base element, and the first annular element is configured to rotate about the shaft element. The input device is configured to generate one or more input signals based on a position of the first annular element and a pivotal movement of the shaft element. The one or more input signals are configured to cause a controller communicatively coupled to the input device to set an operation mode of the wheelchair.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The embodiments set forth in the drawings are illustrative and exemplary in nature and are not intended to limit the subject matter defined by the claims. The following detailed description of the illustrative embodiments can be understood when read in conjunction with the following drawings, where like structure is indicated with like reference numerals and in which:

DETAILED DESCRIPTION

Referring to the figures, embodiments of the present disclosure are generally related to input devices of wheelchairs. In some embodiments, the input device includes a plurality of input elements that are configured to enable a user to easily and readily select an operation mode of the wheelchair, as described below in further detail. Accordingly, the user can safely and easily operate the wheelchair.

Figure 1:
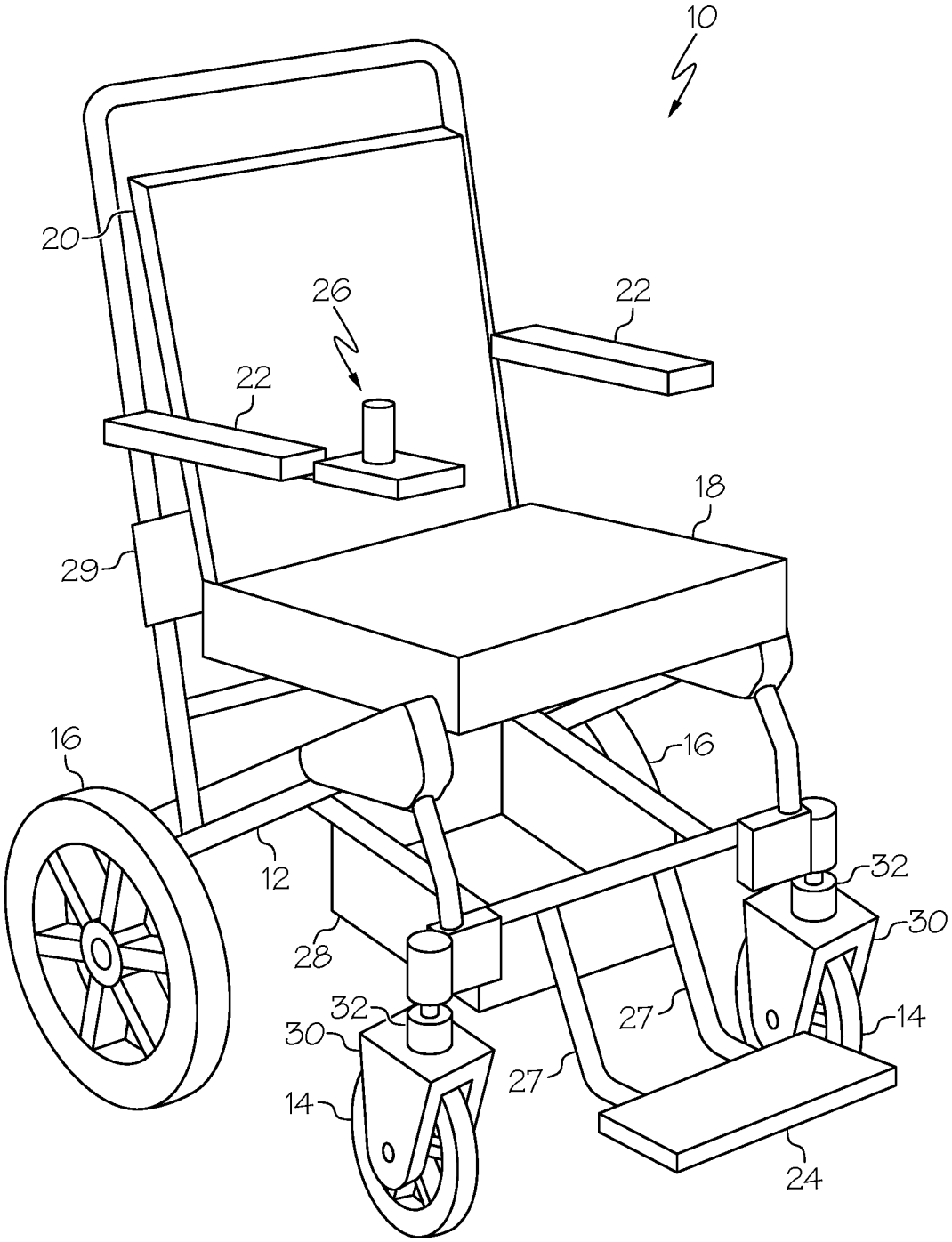
FIG. 1 schematically depicts a perspective view of an example wheelchair according to one or more embodiments shown and described herein.

Referring now to FIG. 1, a perspective view of an example wheelchair 10 is schematically depicted. In some embodiments, the wheelchair 10 includes a frame 12, front wheels 14, rear wheels 16, the seat portion 18, a back portion 20, arm portions 22, foot portion 24, an input device 26, and the motor system 28. While the illustrated embodiment depicts a powered wheelchair (e.g., an electric wheelchair), it should be understood that the wheelchair 10 may be any type of wheelchair in other embodiments, such as a manual wheelchair, a pediatric wheelchair, a stroller, a positional wheelchair, a sports wheelchair, a handcycle, a mobility scooter, a standing wheelchair, a beach wheelchair, etc.

In some embodiments, the front wheels 14 may be rotatably mounted to the frame 12 via caster housings 30. Furthermore, the caster housings 30 may be rotatably mounted to the frame 12 using a respective kingpin 32. In some embodiments, in response to the wheelchair 10 generating a propulsion force (e.g., a user activating a motor system 28 using the input device 26, as described below in further detail), the rear wheels 16 may rotate and roll about the respective kingpin 32. In various embodiments, the wheelchair 10 may stop or reduce the rolling of the front wheels 14 and the rear wheels 16 in response to the motor system 28 reducing a magnitude of the generated propulsion force.

In some embodiments, the seat portion 18 may be fixedly mounted to the frame 12. The seat portion 18 may be mounted to the frame 12 using any suitable linkages, fastening elements, and/or fastening devices. As a non-limiting example, the seat portion 18 provides a user of the wheelchair 10 a location in which he or she can sit. In some embodiments, the seat portion 18 may include a strap for securing a user to the seat portion 18 of the wheelchair 10.

In various embodiments, the back portion 20 is fixedly mounted to the frame 12, and the back portion 20 may be perpendicular to the seat portion 18. As a non-limiting example, the back portion 20 provides structural support and additional comfort to a user's back while he or she is seated in the wheelchair 10. The back portion 20 may be mounted to the frame 12 using any suitable linkages, fastening elements, and/or fastening devices. In some embodiments, the back portion 20 may include a strap for securing a user to the back portion 20 of the wheelchair 10.

In some embodiments, the arm portions 22 extend outwardly from the back portion 20, and the arm portions 22 may be fixedly mounted to the frame 12. As a non-limiting example, the arm portions 22 provide structural support and additional comfort to a user's arms while seated in the wheelchair 10. The arm portions 22 may be mounted to the frame 12 and/or the back portion 20 using any suitable linkages, fastening elements, and/or fastening devices.

In various embodiments, the foot portion 24 may be coupled to the frame 12 via connector elements 27. As a non-limiting example, the foot portion 24 provides structural support and additional comfort to a user's legs and/or feet while seated in the wheelchair 10. In some embodiments, the foot portion 24 may include a strap for fixing a foot of the user to the wheelchair 10.

As depicted in the illustrated embodiment, the wheelchair 10 includes the input device 26. As a non-limiting example, the input device 26 is fixedly mounted to one of the arm portions 22. It should be understood that in other embodiments, the input device 26 may be fixedly mounted to any other location of the wheelchair 10. As described below in further detail, the input device 26 is configured to control the wheelchair 10. Accordingly, in some embodiments, the input device 26 may include an input element (e.g., a switch, lever, button, knob, dial, etc.) or a graphical user interface (GUI) configured to receive an input via an interaction with a GUI element disposed on the GUI (e.g., a button disposed on a touchscreen display). As such, in response to the user interacting with the input elements, the input device 26 may be configured to control the wheelchair 10.

As a non-limiting example, the input device 26 may provide a control signal to the one or more actuators 29 in response to the user interacting with the input elements. Accordingly, the one or more actuators 29 may be configured to activate a respective actuating mechanism (e.g., a stepper motor, a solenoid, etc.) in order to, for example, adjust a position and/or orientation of at least one of the seat portion 18, the back portion 20, the arm portions 22, and the foot portion 24, as described below in further detail. While FIG. 1 illustrates one actuator of the one or more actuators 29 mounted to the frame 12, it should be understood that any number of the one or more actuators 29 may be included in other embodiments, and the one or more actuators 29 may be mounted to the wheelchair 10 at any suitable location.

As another non-limiting example, the input device 26 may provide a control signal to the motor system 28 in response to the user interacting with the input elements. Accordingly, in response to the motor system 28 receiving the control signal, the motor system 28 may output a signal causing the wheelchair 10 to move in a particular direction and at a particular speed, as described below in further detail. As a non-limiting example, the motor system 28 may include one or more motors (shown below in FIGS. 6A-6B) that are mounted to the frame 12. Moreover, each of the motors may include a shaft (not shown) that is rotatably coupled to a respective rear wheel 16 of the wheelchair 10. Accordingly, when the motors are driven by the motor system 28, the rear wheels 16 of the wheelchair 10 are configured to rotate and propel the wheelchair 10 in a corresponding direction.

It should also be understood that other types of wheelchairs may be implemented in other embodiments. As a non-limiting example, the wheelchair may be the exoskeleton wheelchair system as described in U.S. Pat. Pub. No. 2018/0221226. As another non-limiting example, the wheelchair may be the wheelchair system as described in U.S. Pat. Pub. No. 2019/0228465.

Figure 2A:
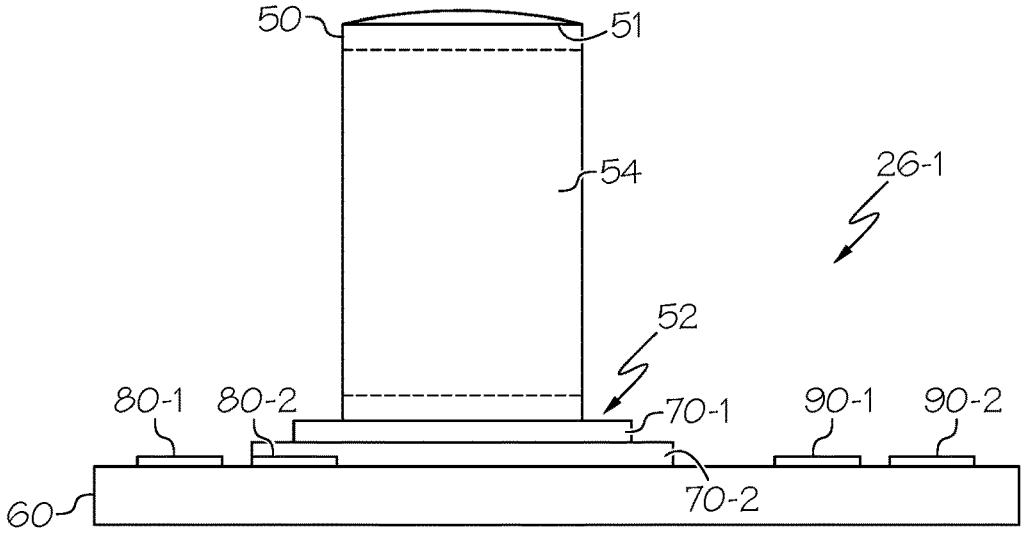
FIG. 2A schematically depicts a side view of an example input device of a wheelchair according to one or more embodiments shown and described herein.
Figure 2B:
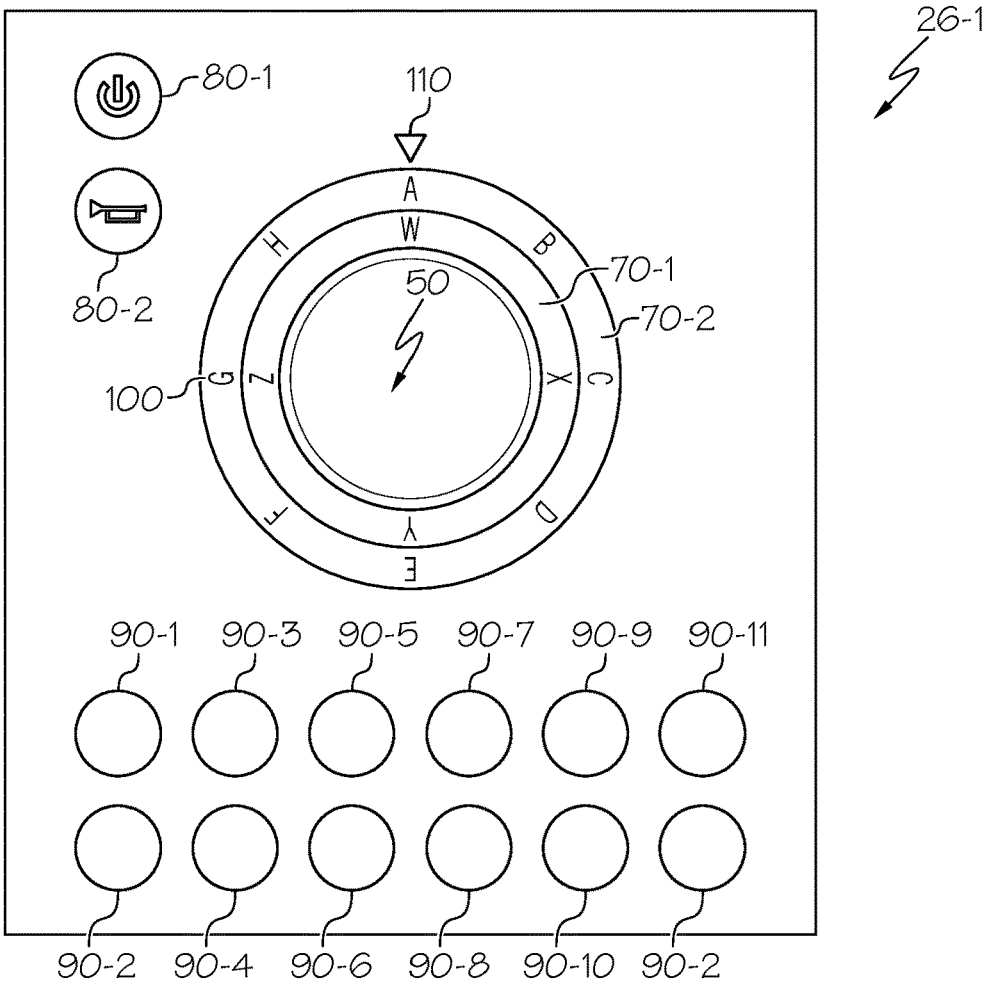
FIG. 2B schematically depicts a top view of an example input device of a wheelchair according to one or more embodiments shown and described herein.

With reference to FIGS. 2A-2B, a side view and a top view, respectively, of an example input device 26-1 of a wheelchair 10 are schematically depicted. As shown in the illustrated embodiments, the example input device 26-1 includes a shaft element 50, a base element 60, and one or more annular elements 70. In various embodiments, the shaft element 50 and the one or more annular elements 70 may be coupled to base element 60, and the base element 60 may be coupled to one of the arm portions 22, for example.

In some embodiments, the shaft element 50 includes an upper distal end 51 and a lower distal end 52 coupled to the base element 60. The shaft element 50 may be configured to pivotally move about the lower distal end 52 of the shaft element 50. Furthermore, the shaft element 50 may be configured to generate an input signal based on the pivotal movement of the shaft element 50. Accordingly, a wheelchair control system (shown below in FIGS. 6A-6B) may receive the input signal and control the wheelchair 10 based on the input signal. As a non-limiting example and as described below in further detail, the wheelchair control system may determine an operation mode and/or operational characteristic of the wheelchair 10 based on the input signal.

In various embodiments, the shaft element 50 may include a sensing region 54. The sensing region 54 may be configured to obtain information corresponding to a user engagement with the shaft element 50 using engagement sensors disposed therein (shown below in FIGS. 6A-6B). As a non-limiting example, the engagement sensors may be one or more sensors (e.g., capacitive sensors, force sensors, resistance sensors, and/or the like) that are configured to generate sensor data corresponding to at least one of a grip force (e.g., a force applied to the shaft element 50), a grip duration (e.g., a period of time in which the user grips and/or touches the shaft element 50), a number of fingers engaged with the shaft element 50, and a grip type (e.g., a partial/full flexion of the user's fingers, thumb, and/or wrist). As another non-limiting example, the engagement sensors may be one or more biometric sensors that are configured to obtain identifying indicia associated with a user, such as a fingerprint sensor. Based on the information corresponding to the user engagement and/or the identifying indicia, the engagement sensors may generate an input signal that is provided to the wheelchair control module (shown below in FIGS. 6A-6B). Accordingly, the wheelchair control system may receive the input signal and control the wheelchair 10 based on the input signal. As non-limiting examples and as described below in further detail, the wheelchair control module may authenticate a user of the wheelchair 10, determine an operation mode and/or operational characteristic of the wheelchair 10, and determine whether the user is properly operating the wheelchair 10 based on the input signal generated by the engagement sensors of the sensing region 54.

In some embodiments, the one or more annular elements 70 may have an annular shape (e.g., a ring shape) and may be circumferentially disposed around the shaft element 50. As a non-limiting example, a first annular element 70-1 may be circumferentially disposed around the shaft element 50, and a second annular element 70-2 may be circumferentially disposed around the shaft element 50 and the first annular element 70-1. While the illustrative embodiment illustrates two annular elements 70, it should be understood that any number of annular elements 70 may be included in other embodiments.

In various embodiments, the one or more annular elements 70 may be configured to rotate about the shaft element 50 in a clockwise and/or counterclockwise direction. As a non-limiting example, the one or more annular elements 70 may rotate in discrete steps (e.g., in magnitudes of 45°) or continuously about the shaft element 50. As described below in further detail, the one or more annular elements 70 may generate an input signal based on the direction/magnitude of rotation. Subsequently, the wheelchair control system (shown below in FIGS. 6A-6B) may determine an operation mode and/or operational characteristic of the wheelchair 10 based on the input signal generated by the one or more annular elements 70.

In some embodiments, the one or more annular elements 70 may be configured to generate auditory feedback as the one or more annular elements 70 are rotating about the shaft element 50. As a non-limiting example, the one or more annular elements 70 may generate a clicking noise or other similar auditory feedback while the one or more annular elements 70 are rotating in one of the clockwise and counterclockwise directions.

Furthermore, each of the one or more annular elements 70 may be movable in an upward and downward direction from the base element 60 in some embodiments. As a non-limiting example, the one or more annular elements 70 may be adjusted such that first annular element 70-1 extends from the base element 60 at a first height, the second annular element 70-2 extends from the base element 60 at a second height, and wherein the second height is greater than the first height. As another non-limiting example, the second height may be less than or equal to the first height. Accordingly, the one or more annular elements 70 may generate an input signal based on the height of the one or more annular elements 70. Subsequently, the wheelchair control module (shown below in FIGS. 6A-6B) may determine an operation mode and/or operational characteristic of the wheelchair 10 based on the input signal generated by the one or more annular elements 70.

In some embodiments, the base element 60 may include a first button 80-1 and a second button 80-2 (collectively referred to as buttons 80). The buttons 80 may be configured to activate certain functions of the wheelchair 10 in response to being actuated (e.g., pressed). As a non-limiting example, in response to pressing the first button 80-1, the motor system 28 may be electrically coupled to an electrical power supply (shown below in FIG. 6A). As another non-limiting example, in response to pressing the second button 80-2, the input device 26 may selectively actuate a horn (not shown) or other auditory element of the wheelchair 10.

In various embodiments, the base element 60 may include base light-emitting diodes (LEDs) 90-1, 90-2, 90-3, 90-4, 90-5, 90-6, 90-7, 90-8, 90-9, 90-10, 90-11, 90-12 (collectively referred to as base LEDs 90). While twelve base LEDs 90 are illustrated in FIG. 2B, it should be understood that any number of base LEDs 90 may be included in other embodiments. The base LEDs 90 may be selectively activated by the wheelchair control module. As a non-limiting example, the base LEDs 90 may be activated to indicate a corresponding operation mode and/or operational characteristic of the wheelchair 10. As a non-limiting example, if the wheelchair 10 is operating in an increased/reduced speed operation mode, at least one of the base LEDs 90 may be selectively activated to indicate the increased/reduced speed operation mode.

As shown in the illustrated embodiment, the one or more annular elements 70 may include a plurality of graphics 100 disposed on the one or more annular elements 70. The plurality of graphics 100 may include characters, text, and/or images indicating an operation mode of the wheelchair 10 (e.g., a forward driving mode, a reverse driving mode, a reduced speed operating mode, an orientation of the seat portion 18 and/or the back portion 20, an orientation of the arm portions 22, etc.). As described below in further detail, rotating the one or more annular elements 70 such that at least one of the plurality of graphics 100 aligns with an alignment indicator 110 disposed on the base element 60 may generate an input signal corresponding to the aligned graphics 100. As a non-limiting example and as shown in the illustrated embodiment, the wheelchair control system may receive an input signal corresponding to an operation mode "AW" of the wheelchair 10 when the user rotates the first annular element 70-1 such that the letter "W" is aligned with the alignment indicator 110 and when the user rotates the second annular element 70-2 such that the letter "A" is aligned with the alignment indicator 110.

While the above embodiments illustrate the plurality of graphics 100 disposed on the one or more annular elements 70, in other embodiments, the one or more annular elements 70 may include other elements that are configured to indicate a wheelchair operation mode and/or an operational characteristic. As a non-limiting example, the one or more annular elements 70 may include a liquid crystal display (LCD) element disposed thereon. By rotating the one or more annular elements 70, the LCD element of the one or more annular elements 70 may be configured to generate a plurality of graphics (e.g., characters, text, and/or images) indicating a corresponding operation mode and/or operational characteristic of the wheelchair 10 (e.g., the wheelchair 10 is driving forward at a normal speed in a standing operation mode).

As another non-limiting example and as described below in further detail with reference to FIG. 2C, the one or more annular elements 70 may include a plurality of LEDs disposed thereon, and the plurality of LEDs may be activated based on the wheelchair operation mode and/or an operational characteristic of the wheelchair 10.

Figure 2C:
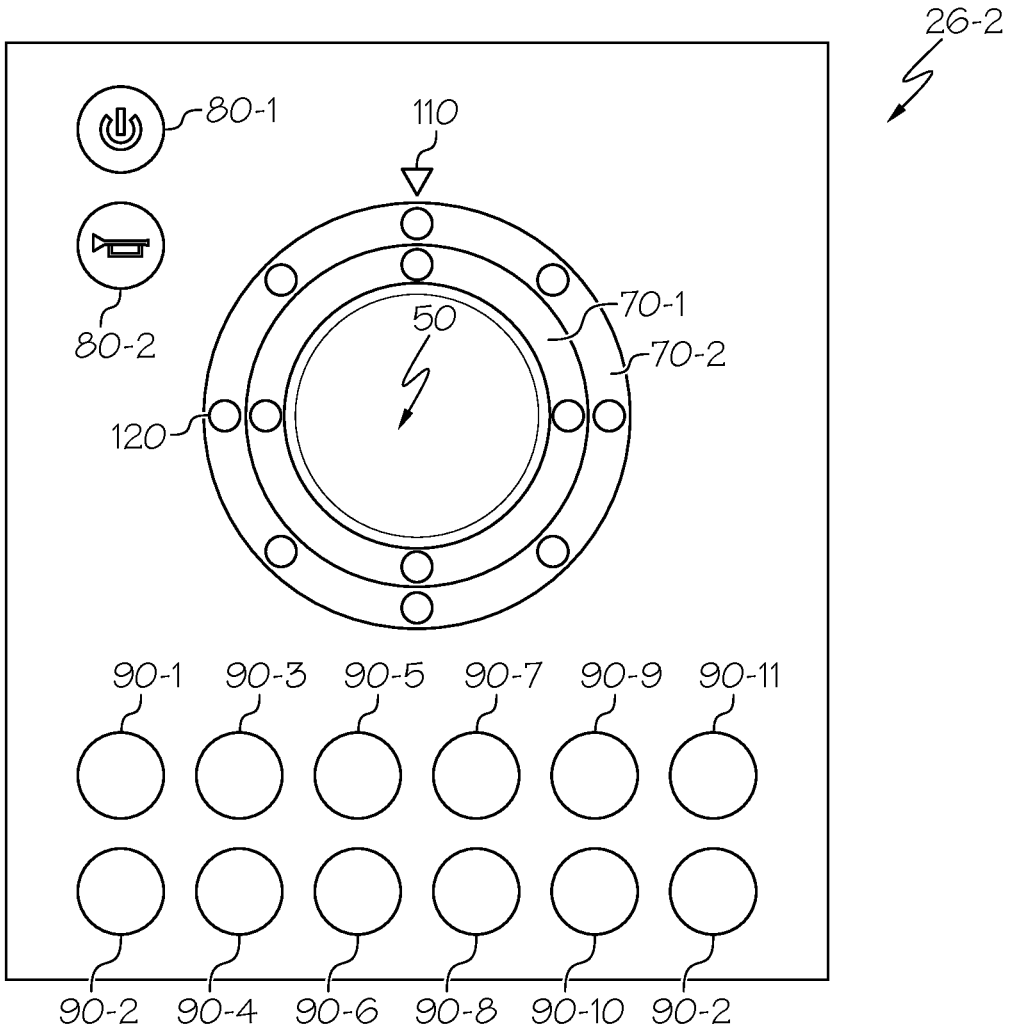
FIG. 2C schematically depicts a top view of another example input device of a wheelchair according to one or more embodiments shown and described herein.

With reference to FIG. 2C, a top view of an example input device 26-2 is schematically depicted. Input device 26-2 is similar to input device 26-1 described above with reference to FIGS. 2A-2B, but in this illustrated embodiment, the one or more annular elements 70 include a plurality of LEDs 120. In some embodiments, the plurality of LEDs 120 may be selectively activated based on an operation mode and/or an operational characteristic of the wheelchair 10. As a non-limiting example, one or more LEDs of the plurality of LEDs 120 may be activated (i.e., turned on and emitting light) when the one or more LEDs are aligned with the alignment indicator 110. Moreover, each of the one or more LEDs of the plurality of LEDs 120 may be activated such that the one or more LEDs indicate a particular operation mode and/or operational characteristic of the wheelchair 10.

It should be understood that in other embodiments, the input devices 26-1, 26-2 described above with reference to FIGS. 2A-2C may include other input elements, such as buttons, switches, knobs, dials, etc. As a non-limiting example and as described below in further detail with reference to FIGS. 3A-3B, the input devices may include a GUI that enables a user to select the operation mode and/or operational characteristics of the wheelchair 10 by interacting with the GUI.

Figure 3A:
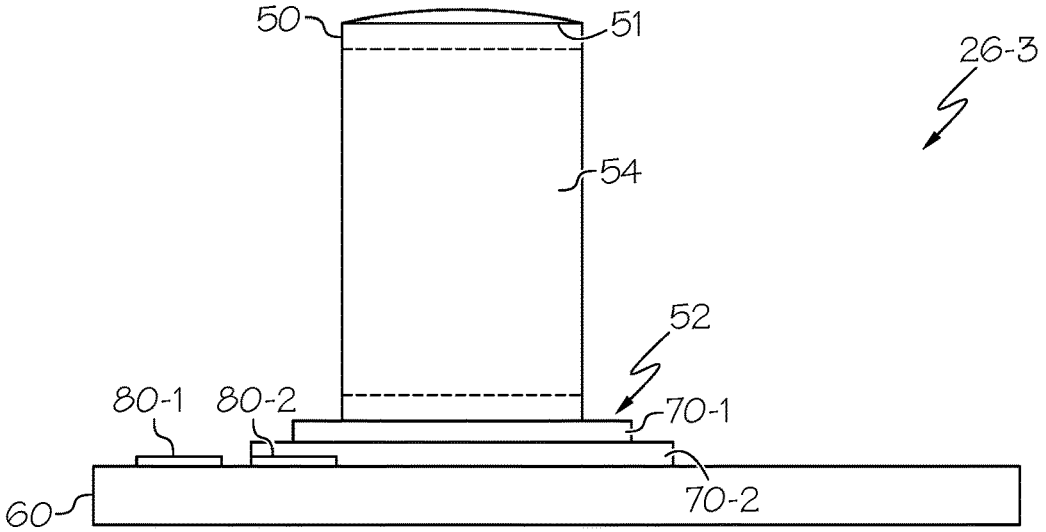
FIG. 3A schematically depicts a side view of yet another example input device of a wheelchair according to one or more embodiments shown and described herein.
Figure 3B:
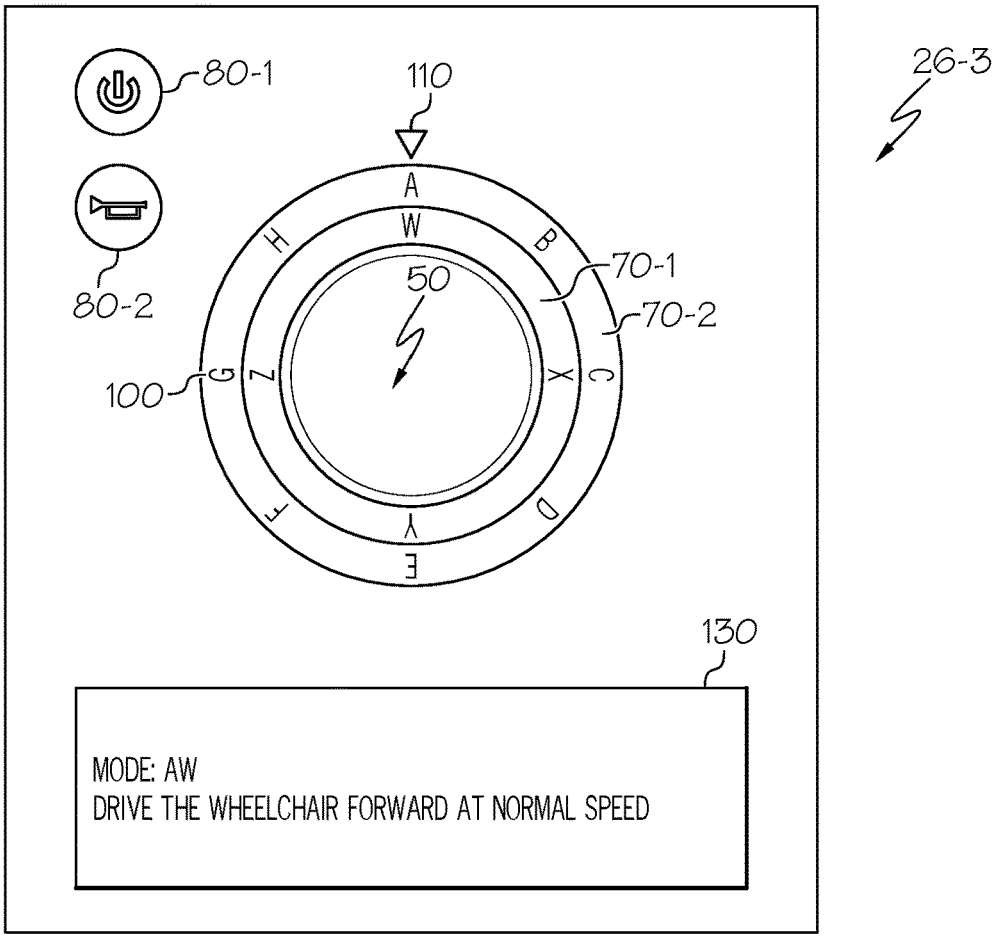
FIG. 3B schematically depicts a top view of yet another example input device of a wheelchair according to one or more embodiments shown and described herein.

With reference to FIGS. 3A-3B, a side view and top view of example input device 26-3, respectively, are schematically depicted. The example input device 26-3 is similar to input devices 26-1, 26-2 described above with reference to FIGS. 2A-2B, but in this illustrated embodiment, the input device 26-3 does not include base LEDs 90 and includes a GUI 130. In some embodiments, the GUI 130 may be configured to generate characters, text, and/or images indicating an operation mode and/or operational characteristic of the wheelchair 10. As a non-limiting example and as illustrated in FIG. 3B, the user may rotate the first annular element 70-1 such that the letter "W" is aligned with the alignment indicator 110 (e.g., the letter "W" represents an operation mode of driving the wheelchair 10 forward), and the user may rotate the second annular element 70-2 such that the letter "A" is aligned with the alignment indicator 110 (e.g., the letter "A" represents an operation mode of driving the wheelchair 10 at a normal speed) in order to set the operation mode of the wheelchair 10 to operation mode "AW." As such, the GUI 130 may display text corresponding to the selected operation mode of the wheelchair 10 in some embodiments. As shown in the illustrated embodiment of FIG. 3B, the GUI 130 may display text indicating that the operation mode is associated with driving the wheelchair 10 forward at a normal speed.

As another non-limiting example, the user may rotate the first annular element 70-1 such that the letter "W" is aligned with the alignment indicator 110 (e.g., the letter "W" represents an operation mode of driving the wheelchair 10 forward), and the user may rotate the second annular element 70-2 such that the letter "D" is aligned with the alignment indicator 110 (e.g., the letter "D" represents a standing operation mode of the wheelchair 10) in order to set the operation mode of the wheelchair 10 to operation mode "WD." As such, the GUI 130 may display text corresponding to the selected operation mode of the wheelchair 10, such as the wheelchair 10 being in an operation mode associated with driving the wheelchair 10 forward in a standing operation mode.

As yet another non-limiting example, the user may rotate the first annular element 70-1 such that the letter "X" is aligned with the alignment indicator 110 (e.g., the letter "X" represents an operation mode of preventing the wheelchair 10 from moving), and the user may rotate the second annular element 70-2 such that the letter "F" is aligned with the alignment indicator 110 (e.g., the letter "F" represents transferring the user from the seat portion 18 to another location) in order to set the operation mode of the wheelchair 10 to operation mode "XF." As such, the GUI 130 may display text corresponding to the selected operation mode of the wheelchair 10, such as the wheelchair 10 being in an operation mode associated with transferring the user from the seat portion 18 to another location.

As yet another non-limiting example, the user may rotate the first annular element 70-1 such that the letter "Y" is aligned with the alignment indicator 110 (e.g., the letter "Y" represents controlling a wheelchair function, such as reclining one of the seat portion 18 and the back portion 20, etc.), and the user may rotate the second annular element 70-2 such that the letter "G" is aligned with the alignment indicator 110 (e.g., the letter "G" represents a parameter of controlling the wheelchair function, such as an adjustment speed, adjustment angle/magnitude, etc.) in order to set the operation mode of the wheelchair 10 to operation mode "YG." As such, the GUI 130 may display text corresponding to the selected operation mode of the wheelchair 10, such as the wheelchair 10 being in an operation mode associated with reclining the seat portion 18 at a predefined angle (e.g., 45°).

In some embodiments, the GUI 130 may be configured to generate various types of information associated with the wheelchair 10. As a non-limiting example, the GUI 130 may generate whether a user of the wheelchair 10 is authenticated (described below in further detail with reference to FIGS.

6A-6B), maintenance information associated with the wheelchair 10, a battery life of the wheelchair 10, and/or any other similar information associated with the wheelchair 10.

While FIGS. 3A-3B illustrate the plurality of graphics 100 disposed on the one or more annular elements 70, in other embodiments, the one or more annular elements 70 may include other elements that are configured to indicate a wheelchair operation mode and/or an operational characteristic. As a non-limiting example and as described below in further detail with reference to FIG. 3C, the one or more annular elements 70 may include a plurality of LEDs that are activated based on the wheelchair operation mode and/or an operational characteristic of the wheelchair 10.

Figure 3C:
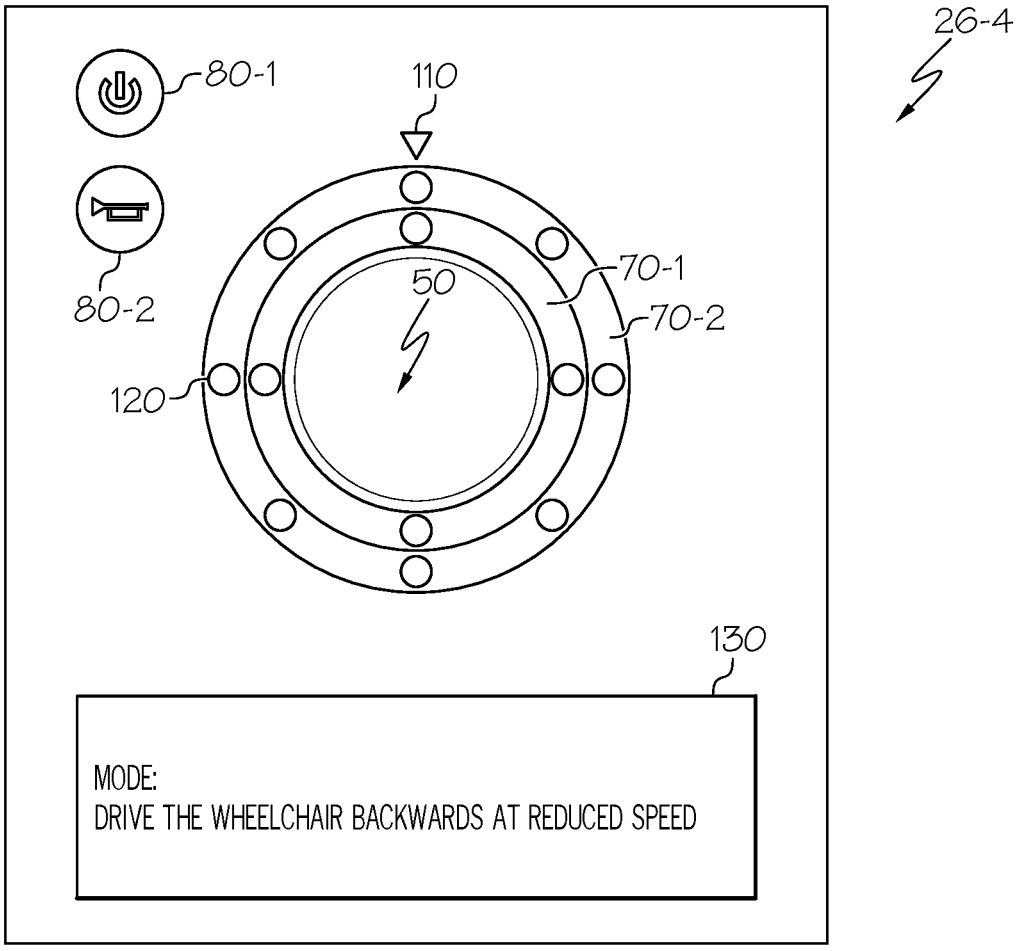
FIG. 3C schematically depicts a top view of yet another example input device of a wheelchair according to one or more embodiments shown and described herein.

With reference to FIG. 3C, a top view of example input device 26-4 is schematically depicted. The example input device 26-4 is similar to input device 26-3 described above with reference to FIGS. 3A-3B, but in this illustrated embodiment, the one or more annular elements 70 include the plurality of LEDs 120. As described above, the plurality of LEDs 120 may be selectively activated based on an operation mode and/or an operational characteristic of the wheelchair 10.

While the above embodiments illustrate the one or more annular elements 70 circumferentially disposed around the shaft element 50, in other embodiments, the one or more annular elements 70 may be removed. Accordingly, in some embodiments, the GUI 130 may include GUI elements disposed on the GUI 130 that are configured to designate an operation mode and/or operational characteristic of the wheelchair 10 in response to a user interaction (e.g., a selection) with the GUI elements, as described below in further detail with reference to FIGS. 4A-4B.

Figure 4A:
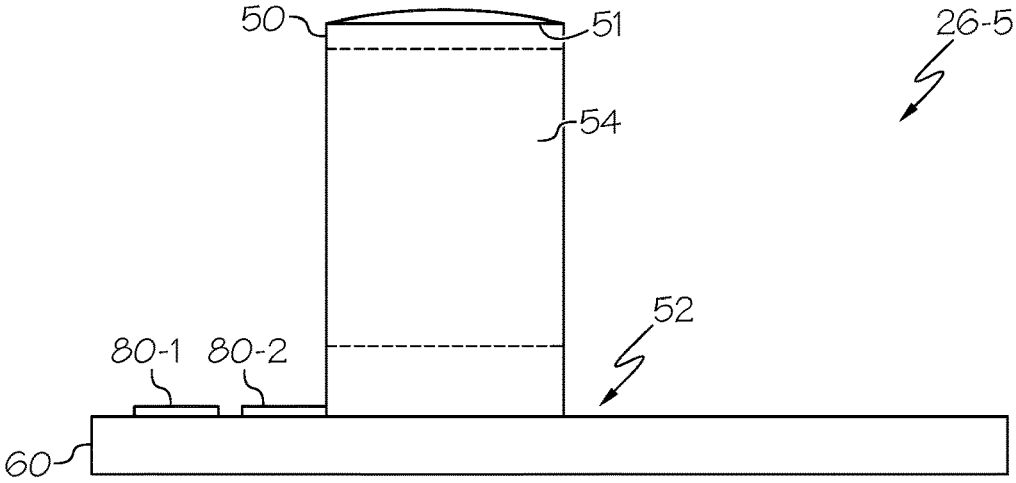
FIG. 4A schematically depicts a side view of yet another example input device of a wheelchair according to one or more embodiments shown and described herein.
Figure 4B:
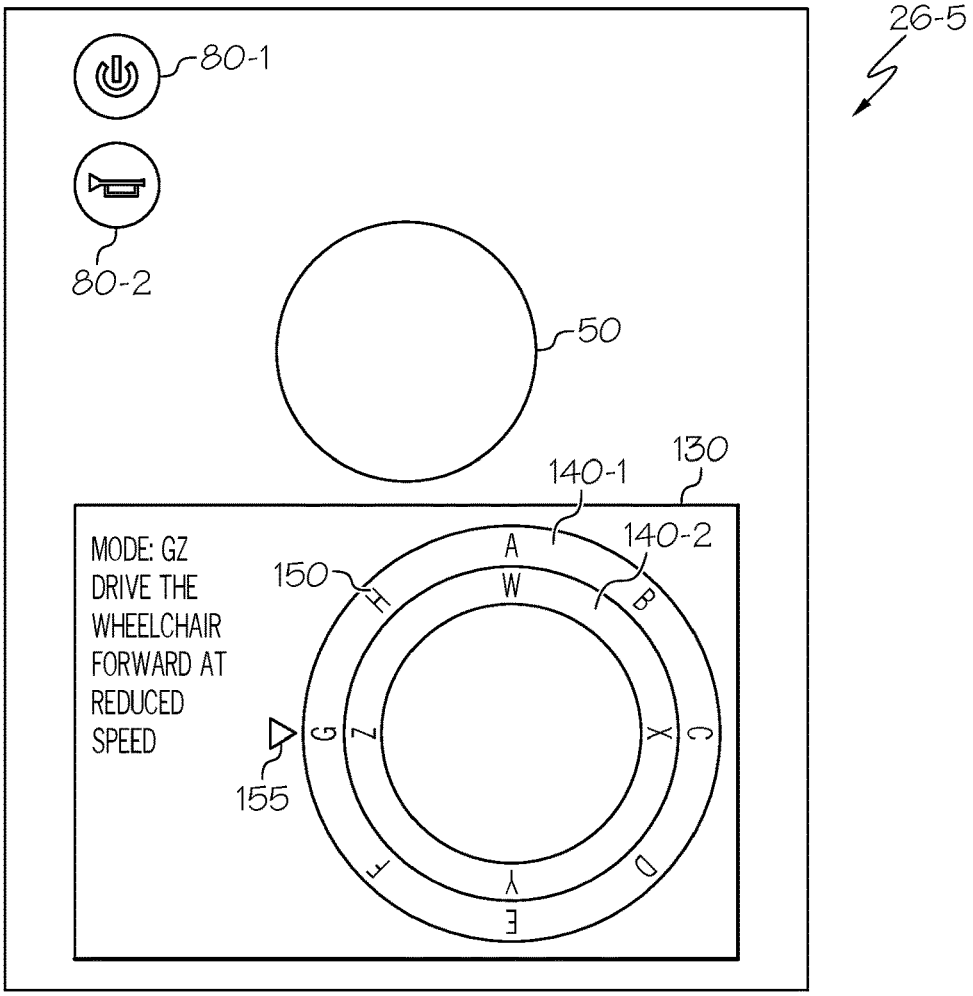
FIG. 4B schematically depicts a top view of yet another example input device of a wheelchair according to one or more embodiments shown and described herein.

With reference to FIGS. 4A-4B, a side view and top view of example input device 26-5, respectively, are schematically depicted. In some embodiments, the GUI 130 may include a first GUI input element 140-1 and a second GUI input element 140-2 (collectively referred to as GUI input elements 140) disposed thereon. While the GUI input elements 140 have annular shapes in the illustrated embodiment, it should be understood that the GUI input elements 140 may have any suitable shape that enables a user to interact with the GUI input elements 140 in other embodiments.

In various embodiments, a user may interact with the GUI input elements 140 in order to select an operation mode and/or operational characteristic of the wheelchair 10. As a non-limiting example, the user may select and rotate at least one of the GUI input elements 140 such that at least one of the plurality of graphics 150 is aligned with alignment indicator 155 disposed on the GUI 130. Based on the selection and rotation of at least one of the GUI input elements 140, the input device 26-5 is configured to generate characters, text, and/or images indicating an operation mode and/or operational characteristic of the wheelchair 10. As a non-limiting example and as illustrated in FIG. 4B, the user may rotate the first GUI input element 140-1 such that the letter "G" is aligned with the alignment indicator 155 (e.g., the letter "G" represents a reduced speed operation mode), and the user may rotate the second GUI input element 140-2 such that the letter "Z" is aligned with the alignment indicator 155 (e.g., the letter "Z" represents driving the wheelchair 10 in the forward direction) in order to set the operation mode of the wheelchair 10 to operation mode "GZ." As such, the GUI 130 may display text corresponding to the selected operation mode of the wheelchair 10 in some embodiments. As shown in the illustrated embodiment of FIG. 4B, the GUI 130 may display text indicating that the operation mode is associated with driving the wheelchair 10 forward at a reduced speed.

Figure 5:
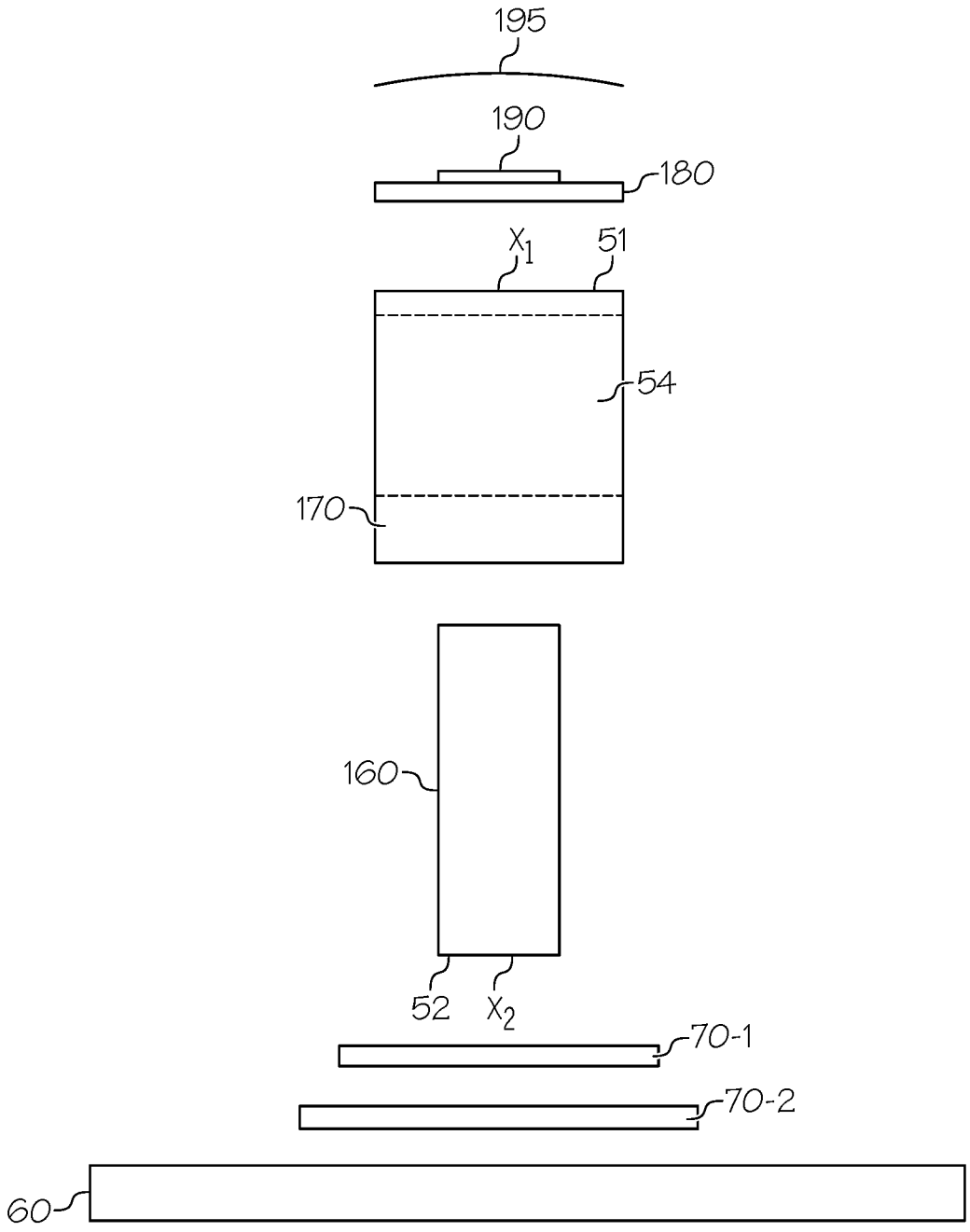
FIG. 5 schematically depicts an exploded view of a base element, one or more annular elements, and a shaft element of an example input device according to one or more embodiments shown and described herein.

With reference to FIG. 5, an exploded view of the shaft element 50, the base element 60, and the one or more annular elements 70 is schematically depicted. As described above, the shaft element 50 may be coupled to the base element 60, and the one or more annular elements 70 may be coupled to the base element 60 and circumferentially disposed around the shaft element 50. In some embodiments, the shaft element 50 may include an inner tubular element 160, an outer tubular element 170, an LED mounting element 180, one or more shaft LEDs 190, and a cap 195.

In some embodiments, the inner tubular element 160 is at least partially disposed within the outer tubular element 170, and the sensing region 54 may be disposed on the outer tubular element 170. In various embodiments, the outer tubular element 170 may be movable relative to the inner tubular element 160. As a non-limiting example, the outer tubular element 170 may be configured to rotate about the inner tubular element 160. As another non-limiting example, the outer tubular element 170 may be configured to slidably move to a plurality of positions along a vertical axis of the shaft element 50, which may extend through a first center point of an upper distal end 51 of the shaft element 50 ($X_1$) and a second center point of the lower distal end 52 of the shaft element 50 ($X_2$). Moreover, the shaft element 50 may generate one or more input signals based on at least one of a rotation of the outer tubular element 170 and a slidable movement of the outer tubular element 170 along the vertical axis of the shaft element 50, as described below in further detail.

In some embodiments, the LED mounting element 180 may be disposed proximate (i.e., adjacent or near) to the upper distal end 51 of the shaft element 50. As a non-limiting example, the LED mounting element 180 may be coupled to the upper distal end 51 of the shaft element 50. As another non-limiting example, the LED mounting element 180 may be disposed within an opening positioned at the upper distal end 51 of the shaft element 50 and coupled to an inner surface of the outer tubular element 170. The LED mounting element 180 may be coupled to the outer tubular element 170 using any suitable fastening and/or coupling elements, such as screws, rivets, and/or other similar devices.

In various embodiments, the LED mounting element 180 is configured to mechanically support the one or more shaft LEDs 190. Additionally, the LED mounting element 180 may include discrete and/or integrated circuit components communicatively coupled to the wheelchair control system (shown below in FIGS. 6A-6B) for selectively activating the one or more shaft LEDs 190 based on the operating mode of the wheelchair 10 and/or operational characteristics of the wheelchair 10, as described below in further detail. In some embodiments, the cap 195, which may include a material that is transparent in the visible spectrum, may be coupled to at least one of the outer tubular element 170 and the LED mounting element 180. Furthermore, the cap 195 may encapsulate the one or more shaft LEDs 190 and the LED mounting element 180 in some embodiments.

Figure 6A:
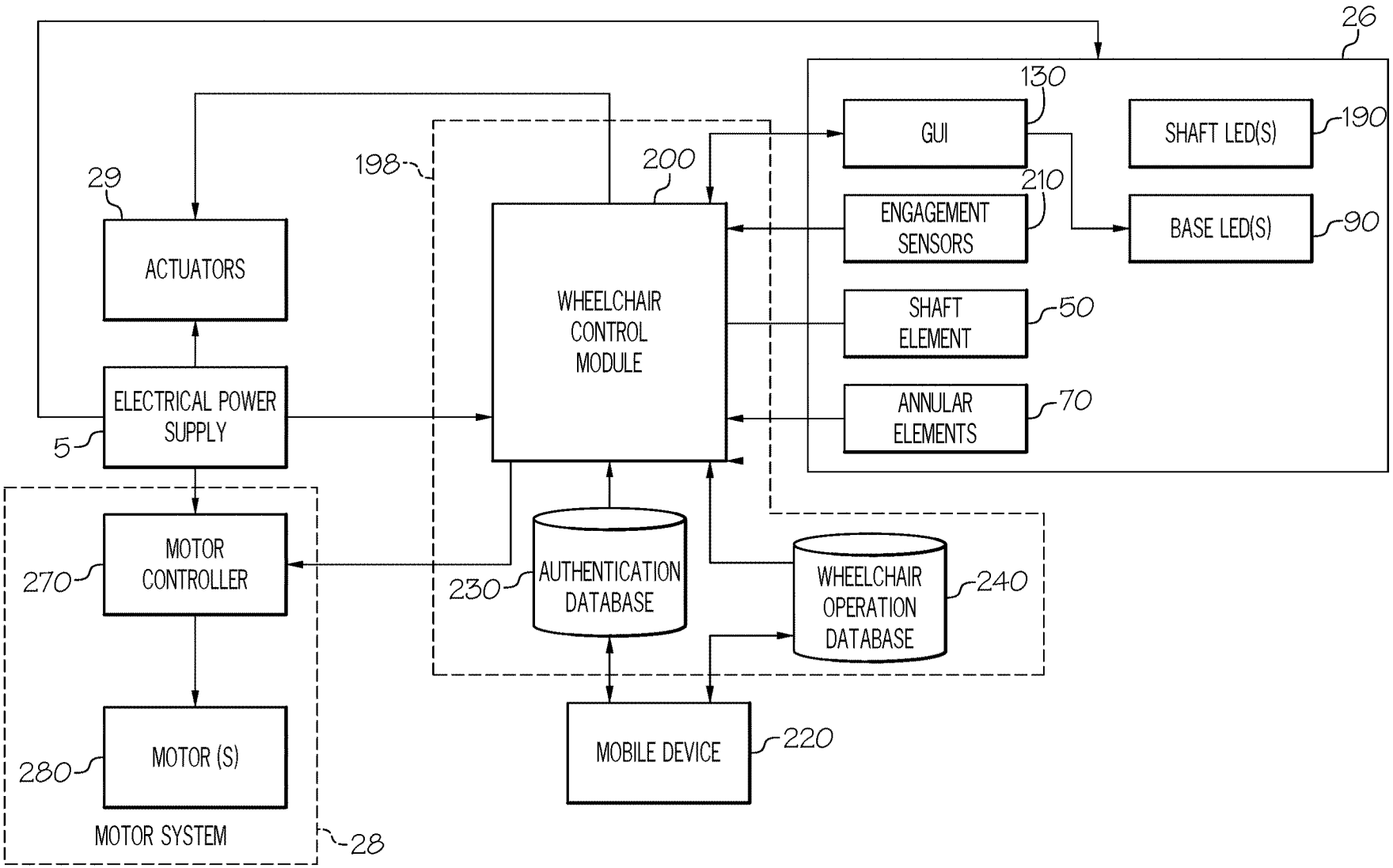
FIG. 6A schematically depicts a functional block diagram of an example wheelchair according to one or more embodiments shown and described herein.

With reference to FIG. 6A, a functional block diagram illustrating various components of the wheelchair 10 is schematically depicted. As described above, the wheelchair 10 includes a power supply 5, a wheelchair control system 198, which includes a wheelchair control module 200, an authentication database 230, and a wheelchair operation database 240. In various embodiments, the wheelchair control module 200 may receive input signals generated by at least one of the shaft element 50, the one or more annular elements 70, the GUI 130, and engagement sensors 210 disposed on the sensing region 54 of the shaft element 50. As described herein, the term module may refer to, be part of, or include: an Application Specific Integrated Circuit (ASIC); a digital, analog, or mixed analog/digital discrete or integrated circuit; a combinational logic circuit; a field programmable gate array (FPGA); a processor circuit that executes machine-readable instructions; a memory circuit that stores machine-readable instructions executed by the processor circuit; other suitable hardware components that provide the described functionality; or a combination of some or all of the above.

In some embodiments, the wheelchair control module 200 may be configured to authenticate a user of the wheelchair 10. The wheelchair control module 200 may authenticate the user of the wheelchair 10 prior to and/or while operating the wheelchair 10. As a non-limiting example, the engagement sensors 210, which may be one or more sensors (e.g., capacitive sensors, force sensors, resistance sensors, and/or the like), may generate sensor data corresponding to at least one of a grip force, a grip duration, a number of fingers engaged with the shaft element 50, and a grip type. The wheelchair control module 200 may then compare the sensor data to one or more entries in an authentication database 230, wherein the one or more entries may be associated with a requisite user engagement associated with the user of the wheelchair 10. The requisite user engagement may represent, for example, a nominal grip force and grip type associated with the user, a required grip duration for activating certain functions of the wheelchair 10, a minimum number of fingers that need to be engaged with the shaft element 50 to activate certain functions, and/or the like. If the sensor data matches the one or more data entries in the authentication database 230, the user of the wheelchair 10 may be authenticated, thereby enabling the user to activate at least a portion of the wheelchair 10 functions. Otherwise, the user of the wheelchair 10 may not be authenticated, thereby prohibiting the user from activating some or all of the functions of the wheelchair 10.

As another non-limiting example, the engagement sensors 210, which may be one or more biometric sensors, may obtain fingerprint data associated with the user of the wheelchair 10. The wheelchair control module 200 may then compare the fingerprint data to one or more entries in an authentication database 230, wherein the one or more entries may be associated with fingerprint data corresponding to authorized users of the wheelchair 10. If the fingerprint data matches the one or more data entries in the authentication database 230, the user of the wheelchair 10 may be authenticated, thereby enabling the user to activate at least a portion of the wheelchair 10 functions. Otherwise, the user of the wheelchair 10 may not be authenticated, thereby prohibiting the user from activating some or all of the functions of the wheelchair 10.

In some embodiments, the mobile device 220 may be configured to generate the one or more entries in the authentication database 230. As a non-limiting example, the user may use a fingerprint sensor of the mobile device 220 (e.g., a smartphone, laptop, desktop computer, PDA, tablet, or other similar computing device) to generate the fingerprint data. As another non-limiting example, the user may use the mobile device 220 to generate the one or more entries by manually defining the requisite user engagement for activating at least a portion of the wheelchair functions (e.g., a healthcare provider prescribing the wheelchair 10 may use the mobile device 220 to generate an entry indicating that the patient/operator of the wheelchair 10 must use at least three fingers to activate a function of the wheelchair 10).

In some embodiments, the mobile device 220 may be configured to provide visual and/or auditory instructions to assist the user in generating the one or more entries in the authentication database 230. As a non-limiting example, the mobile device 220 may generate graphics and/or text on a display of the mobile device 220 with instructions for calibrating the wheelchair 10, which may include generating one or more entries corresponding to the fingerprint data, the nominal grip force data, and the nominal grip type data.

In various embodiments, the wheelchair operation database 240 may include one or more entries corresponding to the various wheelchair operation modes and operational characteristics of the wheelchair 10. As a non-limiting example, the wheelchair operation database 240 may include one or more entries corresponding to various operation modes, such as driving the wheelchair 10 forwards/backwards at reduced, normal, and increased speeds. As another non-limiting example, the wheelchair operation database 240 may include one or more entries corresponding to additional wheelchair operation modes, such as driving the wheelchair 10 in a manual, semiautonomous, and autonomous mode; and driving the wheelchair on a flat terrain and uneven terrain.

As yet another non-limiting example, the wheelchair operation database 240 may include one or more entries corresponding to various operational characteristics, such as a nominal orientation of one of the seat portion 18, the back portion 20, the arm portions 22, and the foot portion 24; and an adjusted orientation of one of the seat portion 18, the back portion 20, the arm portions 22, and the foot portion 24. As yet another non-limiting example, the wheelchair operation database 240 may include one or more entries corresponding to additional operational characteristics, such as a nominal height of one of the seat portion 18, the back portion 20, the arm portions 22, and the foot portion 24; and an adjusted height of one of the seat portion 18, the back portion 20, the arm portions 22, and the foot portion 24.

The mobile device 220 may also be configured to generate the one or more entries in the wheelchair operation database 240. In some embodiments, the user may use the mobile device 220 to generate the one or more entries by manually defining the various operation modes and/or operational characteristics. As a non-limiting example, a healthcare provider prescribing the wheelchair 10 may use the mobile device 220 to generate one or more entries indicating that the patient/operator of the wheelchair 10 may drive the wheelchair 10 forwards at normal speeds and backwards at reduced speeds. As another non-limiting example, the healthcare provider may generate one or more entries indicating that the patient/operator is able to set each component except for the back portion 20 to either the nominal or adjusted orientation, and the back portion 20 must remain at the nominal orientation. While the above examples describe a healthcare provider generating the one or more entries using the mobile device 220, it should be understood that the user of the wheelchair 10 may generate the one or more entries in other embodiments.

In some embodiments, the mobile device 220 may be configured to provide visual and/or auditory instructions to assist the user in generating the one or more entries in the wheelchair operation database 240. As a non-limiting example, the mobile device 220 may generate graphics and/or text on a display of the mobile device 220 with instructions for calibrating the wheelchair 10, which may include generating one or more entries corresponding to the wheelchair operation modes and the wheelchair operational characteristics.

As described above, the wheelchair control module 200 may receive one or more input signals generated by at least one of the shaft element 50, the one or more annular elements 70, the GUI 130, and engagement sensors 210 disposed on the sensing region 54 of the shaft element 50. In an example embodiment, the wheelchair control module 200 may receive a first input signal corresponding to at least one of a pivotal movement, rotational movement, and slidable movement of the shaft element 50, and the wheelchair control module 200 may receive a second input signal corresponding to at least one of a rotational and upward/downward movement of the one or more annular elements 70. Furthermore, the wheelchair control module 200 may receive a third input signal corresponding to the user engagement with shaft element 50 from the engagement sensors 210. Subsequently, the wheelchair control module 200 may compare at least one of the first, second, and third input signals to one or more entries in the wheelchair operation database 240 to determine an operation mode and/or operational characteristics of the wheelchair 10. As a non-limiting example, the wheelchair control module 200 may determine that the first, second, and third input signals indicate that the user has selected an operation mode corresponding to driving forwards at a reduced speed and an operational characteristic of reclining the seat portion 18 and back portion 20, and that the user is authenticated to drive forwards at reduced speeds and to recline the seat portion 18 and the back portion 20.

In another example embodiment, the wheelchair control module 200 may receive a first input signal corresponding to at least one of a pivotal movement, rotational movement, and slidable movement of the shaft element 50, and the wheelchair control module 200 may receive a second input signal corresponding to a user interaction with the GUI 130. Furthermore, the wheelchair control module 200 may receive a third input signal corresponding to the user engagement with the shaft element 50 from the engagement sensors 210. Subsequently, the wheelchair control module 200 may compare at least one of the first, second, and third input signal to one or more entries in the wheelchair operation database 240 to determine an operation mode and/or operational characteristics of the wheelchair 10. As a non-limiting example, the wheelchair control module 200 may determine that the first, second, and third input signals indicate that the user has selected an operation mode corresponding to driving forwards at an increased speed and an operational characteristic of setting each component of the wheelchair 10 to a nominal orientation based on the comparison, and that the user is authenticated to drive forwards at increased speeds and to set each component of the wheelchair 10 to the nominal orientation.

In response to determining the operation mode and/or operational characteristics of the wheelchair 10, the wheelchair control module 200 may be configured to output a control signal to at least one of the motor system 28 and the one or more actuators 29. In some embodiments, the control signal may be configured to adjust the operating characteristics of a motor controller 270 of the motor system 28 such that it corresponds to the selected operation mode. As a non-limiting example, if the operation mode indicates that the user of the wheelchair 10 desires to drive the wheelchair 10 backwards at a reduced speed, the control signal may cause the motor controller 270 to drive one or more motors 280 of the motor system 28 in the reverse direction. As another non-limiting example, if the operational characteristics indicate that the back portion 20 needs to adjust its orientation such that it is reclined, the control signal may activate the one or more actuators 29 and thereby adjust the orientation of the back portion 20 accordingly.

Figure 6B:
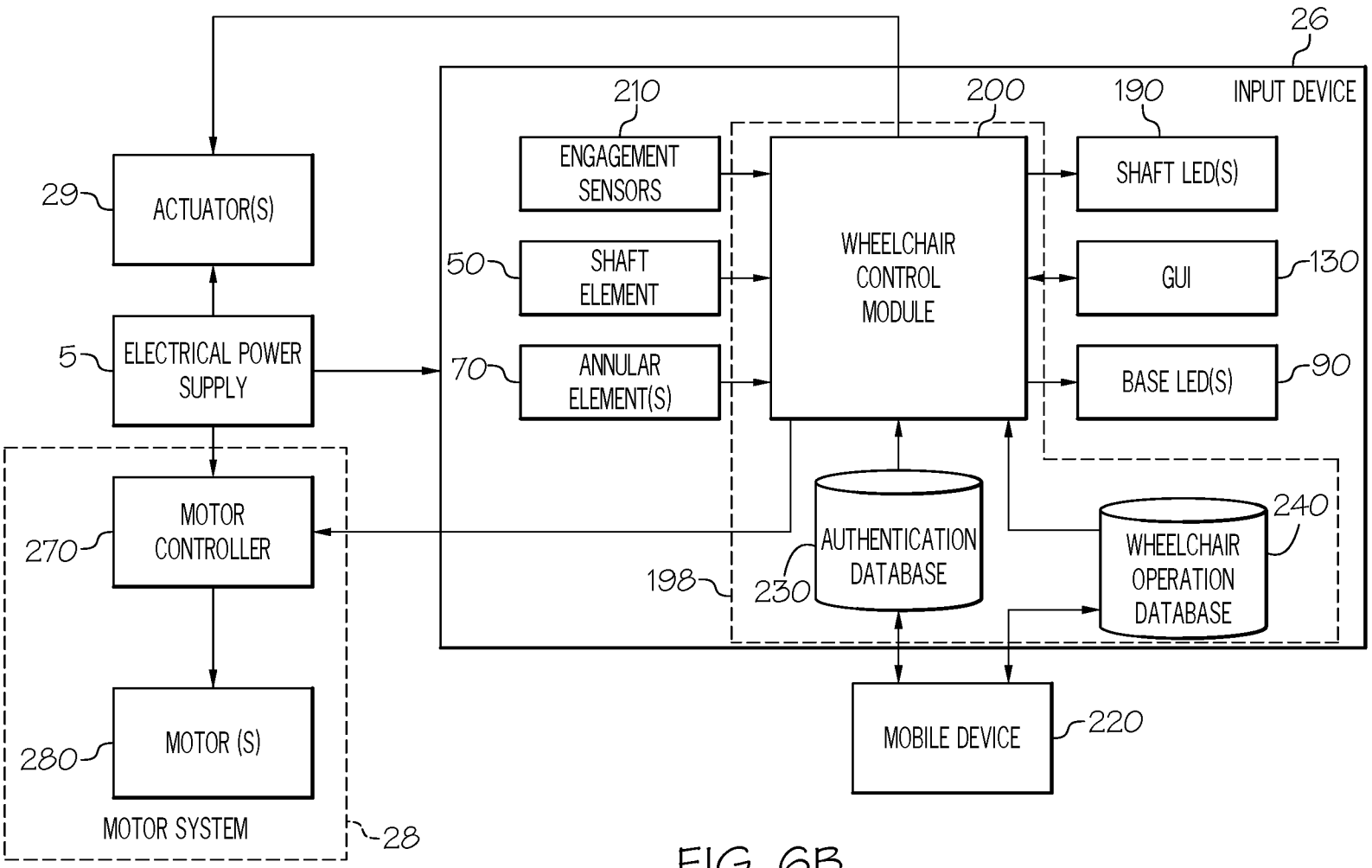
FIG. 6B schematically depicts a functional block diagram of another example wheelchair according to one or more embodiments shown and described herein.

While the wheelchair control system 198 in FIG. 6A is illustrated as a separate component of the wheelchair 10, it should be understood that the at least some of the components of the wheelchair control system 198 may be included within the motor system 28 and the input device 26 in other embodiments. As a non-limiting example and as illustrated in FIG. 6B, the wheelchair control system 198 may be entirely included within the input device 26.

Figure 7:
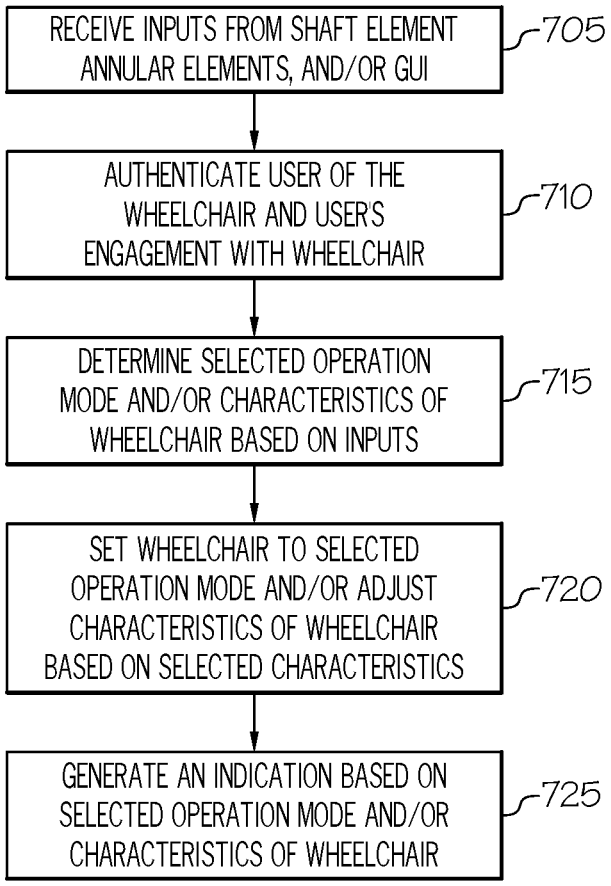
FIG. 7 depicts a flow diagram of an illustrative method for setting an operation mode of the wheelchair according to one or more embodiments shown and described herein.

With reference to FIG. 7, a flow diagram of an illustrative method for setting an operation mode of the wheelchair 10 is depicted. At block 705, the wheelchair control module 200 receives one or more input signals from the shaft element 50, the one or more annular elements 70, and/or the GUI 130. At block 710, the wheelchair control module 200 authenticates the user of the wheelchair 10 and the user's engagement with the wheelchair 10 based on the information obtained by the engagement sensors 210 of the shaft element 50 and the one or more entries in the authentication database 230. At block 715, the wheelchair control module 200 determines the selected operation mode and/or operational characteristics of the wheelchair 10 based on the one or more input signals. At block 720, the wheelchair 10 is set to the selected operation mode when the wheelchair control module 200 outputs a control signal to the motor system 28 based on the one or more input signals. Furthermore, at block 720, the operational characteristics of the wheelchair 10 is set to the selected characteristics when the wheelchair control module 200 outputs a control signal to one of the one or more actuators 29 based on the one or more input signals. At block 725, the wheelchair control module 200 selectively activates the one or more base LEDs 90 and/or the one or more shaft LEDs 190 based on the determined operation mode and/or operational characteristics of the wheelchair 10.

Figure 8:
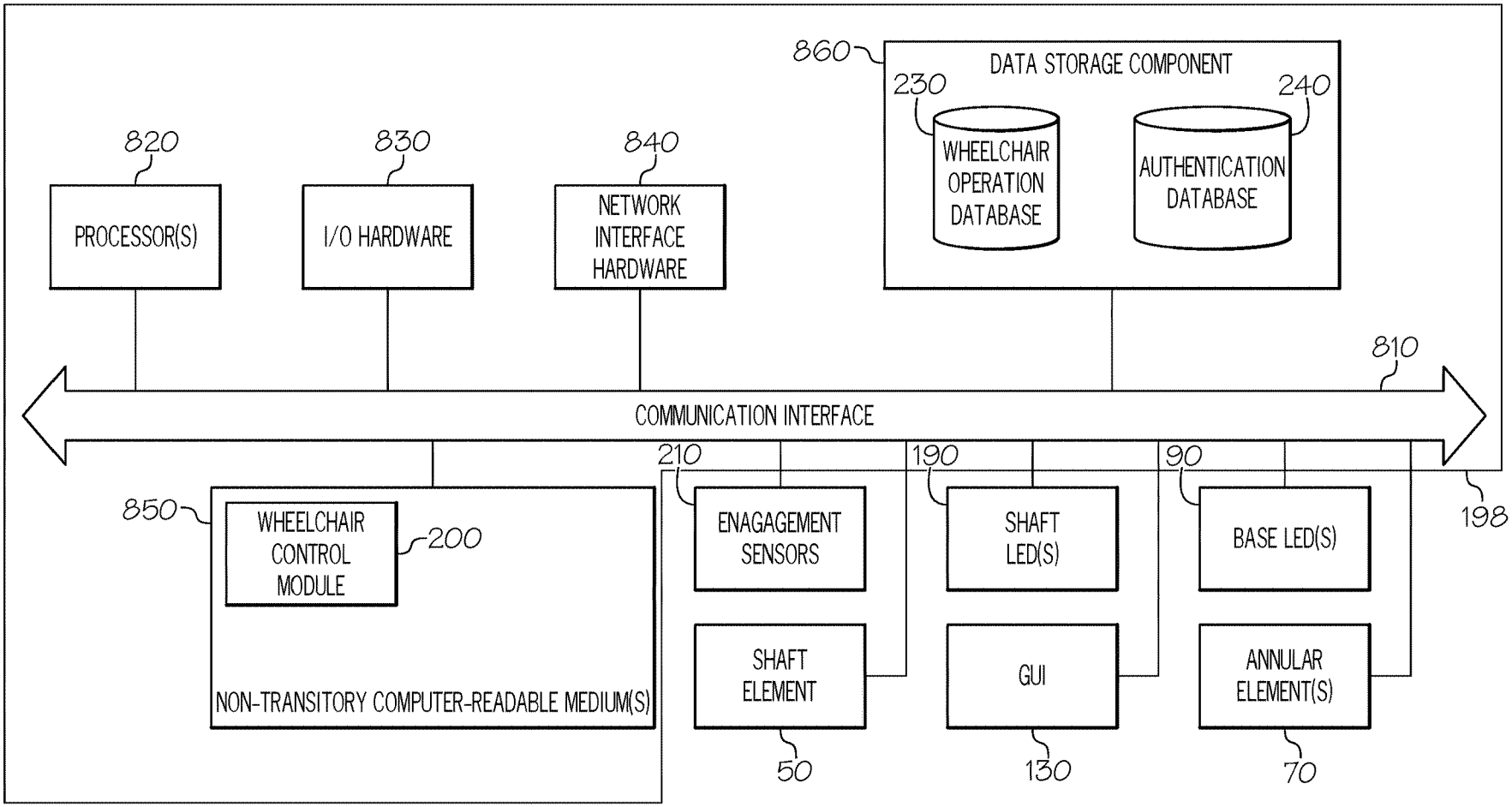
FIG. 8 schematically depicts a wheelchair control system of an example wheelchair according to one or more embodiments shown and described herein.

The functional blocks and/or flowchart elements described herein may be translated into machine-readable instructions. As non-limiting examples, the machine-readable instructions may be written using any programming protocol, such as: descriptive text to be parsed (e.g., such as hypertext markup language, extensible markup language, etc.), (ii) assembly language, (iii) object code generated from source code by a compiler, (iv) source code written using syntax from any suitable programming language for execution by an interpreter, (v) source code for compilation and execution by a just-in-time compiler, etc. Alternatively, the machine-readable instructions may be written in a hardware description language (HDL), such as logic implemented via either a field programmable gate array (FPGA) configuration or an application-specific integrated circuit (ASIC), or their equivalents. Accordingly, the functionality described herein may be implemented in any conventional computer programming language, as pre-programmed hardware elements, or as a combination of hardware and software components With reference to FIG. 8, an example embodiment of the wheelchair control system 198 is schematically depicted. The wheelchair control system 198 generally includes a communication interface 810, one or more processors 820, input/output hardware 830, network interface hardware 840, a one or more non-transitory computer-readable mediums 850, and a data storage component 860. The components of the wheelchair control system 198 may be physically and/or communicatively coupled through the communication interface 810, and the wheelchair control system 198 may be physically and/or communicatively coupled to the motor system 28, the input device 26, and the one or more actuators 29 through the communication interface 810.

The communication interface 810 is formed from any medium that is configured to transmit a signal. As non-limiting examples, the communication interface 810 is formed of conductive wires, conductive traces, optical waveguides, or the like. The communication interface 810 may also refer to the expanse in which electromagnetic radiation and their corresponding electromagnetic waves are propagated. Moreover, the communication interface 810 may be formed from a combination of mediums configured to transmit signals. In one embodiment, the communication interface 810 includes a combination of conductive traces, conductive wires, connectors, and buses that cooperate to permit the transmission of electrical data signals to and from the various components of the wheelchair control system 198. Additionally, it is noted that the term "signal" means a waveform (e.g., electrical, optical, magnetic, mechanical or electromagnetic) configured to travel through a medium, such as DC, AC, sinusoidal-wave, triangular-wave, square-wave, vibration, and the like.

The one or more processors 820 may be any device of capable of executing machine-readable instructions stored in the non-transitory computer-readable medium 850. As a non-limiting example, the one or more processors 820 may be one of a shared processor circuit, dedicated processor circuit, or group processor circuit. As described herein, the term shared processor circuit refers to a single processor circuit that executes some or all machine-readable instructions from the wheelchair control module 200. As described herein, the term group processor circuit refers to a processor circuit that, in combination with additional processor circuits, executes some or all machine-executable instructions from the wheelchair control module 200. References to multiple processor circuits encompass multiple processor circuits on discrete dies, multiple processor circuits on a single die, multiple cores of a single processor circuit, multiple threads of a single processor circuit, or a combination of the above.

The input/output hardware 830 may refer to a basic input/output system (BIOS) that interacts with hardware of the wheelchair control system 198, device drivers that interact with particular devices of the wheelchair control system 198, one or more operating systems, user applications, background services, background applications, etc.

The network interface hardware 840 may include and/or be configured to communicate with any wired or wireless networking hardware, including an antenna, a modem, a LAN port, a wireless fidelity (Wi-Fi) card, a WiMax card, a long term evolution (LTE) card, a ZigBee card, a Bluetooth chip, a USB card, a mobile communications hardware, and/or other hardware for communicating with other networks and/or devices.

The one or more non-transitory computer-readable mediums 850 are communicatively coupled to the one or more processors 820. As a non-limiting example, one or more non-transitory computer-readable mediums 850 may be one of a shared memory circuit, dedicated memory circuit, or group memory circuit. As described herein, the term shared memory circuit refers to a single memory circuit that stores some or all machine-readable instructions from the wheelchair control module 200. As described herein, the term group memory circuit refers to a memory circuit that, in combination with additional memories, stores some or all machine-readable instructions from the wheelchair control module 200.

The data storage component 860, which includes the authentication database 230 and the wheelchair operation database 240, is communicatively coupled to the one or more processors 820. As a non-limiting example, the data storage component 860 may include one or more database servers that support NoSQL, MySQL, Oracle, SQL Server, NewSQL, or the like.

It should now be understood that embodiments of the present disclosure are directed to input devices of wheelchairs. Accordingly, the input devices described herein includes a plurality of input elements that enable a user to easily and readily select an operation mode and/or operational characteristics of the wheelchair, thereby enhancing the user's experience and improving the safety while the user operates the wheelchair.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the disclosure should be construed to include everything within the scope of the appended claims and their equivalents.

The invention claimed is:

1. A system for controlling a wheelchair, the system comprising:

an input device comprising a shaft element, a base element, and one or more annular elements, wherein:

a lower distal end of the shaft element is coupled to the base element;

the shaft element is configured to pivotally move about the lower distal end of the shaft element;

a first annular element of the one or more annular elements is circumferentially disposed around the shaft element;

the first annular element is coupled to the base element;

the first annular element is configured to rotate about the shaft element;

a second annular element of the one or more annular elements is circumferentially disposed around the first annular element, is coupled to the base element, and is configured to rotate about the shaft element;

the input device is configured to generate one or more input signals based on a position of the first annular element, a position of the second annular element, and a pivotal movement of the shaft element; and the one or more input signals are configured to cause a controller communicatively coupled to the input device to set an operation mode of the wheelchair.

2. The system of claim 1, wherein the controller includes one or more processors, one or more databases, and one or more non-transitory memory modules communicatively coupled to the one or more processors and storing machine-readable instructions that, when executed, cause the one or more processors to perform at least the following:

receive a first input signal of the one or more input signals, wherein the first input signal corresponds to the position of the first annular element;

receive a second input signal of the one or more input signals, wherein the second input signal corresponds to the pivotal movement of the shaft element;

determine the operation mode of the wheelchair based on the first input signal and the second input signal; and set the wheelchair to the determined operation mode.

3. The system of claim 2, wherein the one or more non-transitory memory modules further comprise machine-readable instructions that, when executed, cause the one or more processors to perform at least the following:

receive a third input signal from a second annular element of the one or more annular elements, wherein the third input signal corresponds to a position of the second annular element; and determine the operation mode of the wheelchair based on the third input signal.

4. The system of claim 2, wherein the one or more non-transitory memory modules further comprise machine-readable instructions that, when executed, cause the one or more processors to perform at least the following:

receive a third input signal of the one or more input signals from one or more sensors disposed on the shaft element, wherein the third input signal indicates a user engagement with the shaft element;

determine whether the third input signal matches an entry in an authentication database; and in response to determining that the third input signal matches the entry in the authentication database, determine the operation mode of the wheelchair based on the third input signal.

5. The system of claim 4, wherein the user engagement includes one of a grip force, a grip duration, a number of fingers engaged with the shaft element, and a grip type.

6. The system of claim 1, wherein the shaft element further comprises an outer tubular element and an inner tubular element, and wherein:

the inner tubular element disposed within the outer tubular element;

the outer tubular element is configured to rotate about the inner tubular element; and the outer tubular element is configured to slidably move to a plurality of positions along a vertical axis of the shaft element, wherein the vertical axis extends through a first center point of an upper distal end of the shaft element and a second center point of the lower distal end of the shaft element.

7. The system of claim 6, wherein the controller includes one or more processors, one or more databases, and one or more non-transitory memory modules communicatively coupled to the one or more processors and storing machine-readable instructions that, when executed, cause the one or more processors to perform at least the following:

receive a first input signal of the one or more input signals, wherein the first input signal corresponds to a rotational movement of the outer tubular element;

receive a second input signal of the one or more input signals, wherein the second input signal corresponds to a slidable movement of the outer tubular element;

determine the operation mode of the wheelchair based on the first input signal and the second input signal; and set the wheelchair to the determined operation mode.

8. A system for controlling a wheelchair, the system comprising:

an input device comprising a shaft element, a base element, and one or more annular elements, wherein:

a lower distal end of the shaft element is coupled to the base element;

the shaft element is configured to pivotally move about the lower distal end of the shaft element;

a first annular element of the one or more annular elements is configured to rotate in response to an interaction with the first annular element;

a second annular element of the one or more annular elements is configured to rotate in response to an interaction with the second annular element;

the input device is configured to generate one or more input signals based on a position of the first annular element, the second annular element, and a pivotal movement of the shaft element; and the one or more input signals are configured to cause a controller communicatively coupled to the shaft element and the one or more annular elements to set an operation mode of the wheelchair.

9. The system of claim 8, wherein the controller includes one or more processors, one or more databases, and one or more non-transitory memory modules communicatively coupled to the one or more processors and storing machine-readable instructions that, when executed, cause the one or more processors to perform at least the following:

receive a first input signal of the one or more input signals, wherein the first input signal corresponds to the interaction with the first annular element;

receive a second input signal of the one or more input signals, wherein the second input signal corresponds to the pivotal movement of the shaft element;

determine the operation mode of the wheelchair based on the first input signal and the second input signal; and set the wheelchair to the operation mode.

10. The system of claim 9, wherein the one or more non-transitory memory modules further comprise machine-readable instructions that, when executed, cause the one or more processors to perform at least the following:

receive a third input signal from a second annular element of the one or more annular elements, wherein the third input signal corresponds to the interaction with the second annular element; and determine the operation mode of the wheelchair based on the third input signal.

11. The system of claim 9, wherein the one or more non-transitory memory modules further comprise machine-readable instructions that, when executed, cause the one or more processors to perform at least the following:

receive a third input signal of the one or more input signals from one or more sensors disposed on the shaft element, wherein the third input signal indicates a user engagement with the shaft element;

determine whether the third input signal matches an entry in an authentication database; and in response to determining that the third input signal matches the entry in the authentication database, determine the operation mode of the wheelchair based on the third input signal.

12. The system of claim 11, wherein the user engagement includes one of a grip force, a grip duration, a number of fingers engaged with the shaft element, and a grip type.

13. The system of claim 8, wherein the shaft element further comprises an outer tubular element and an inner tubular element, and wherein:

the inner tubular element disposed within the outer tubular element;

the outer tubular element is configured to rotate about the inner tubular element; and the outer tubular element is configured to slidably move to a plurality of positions along a vertical axis of the shaft element, wherein the vertical axis extends through a first center point of an upper distal end of the shaft element and a second center point of the lower distal end of the shaft element.

14. The system of claim 13, wherein the controller includes one or more processors, one or more databases, and one or more non-transitory memory modules communicatively coupled to the one or more processors and storing machine-readable instructions that, when executed, cause the one or more processors to perform at least the following:

receive a first input signal of the one or more input signals, wherein the first input signal corresponds to a rotational movement of the outer tubular element;

receive a second input signal of the one or more input signals, wherein the second input signal corresponds to a slidable movement of the outer tubular element; and determine the operation mode of the wheelchair based on the first input signal and the second input signal; and set the wheelchair to the determined operation mode.

15. A system comprising:

a wheelchair; and an input device comprising a shaft element, a base element, and one or more annular elements, wherein:

a lower distal end of the shaft element is coupled to the base element;

the shaft element is configured to pivotally move about the lower distal end of the shaft element;

a first annular element of the one or more annular elements is circumferentially disposed around the shaft element;

the first annular element is coupled to the base element;

the first annular element is configured to rotate about the shaft element;

the input device is configured to generate one or more input signals based on a position of the first annular element and a pivotal movement of the shaft element; and the one or more input signals are configured to cause a controller communicatively coupled to the input device to set an operation mode of the wheelchair.

16. The system of claim 15, wherein the one or more annular elements comprise a second annular element, and wherein:

the second annular element is configured to rotate about the shaft element;

the second annular element is circumferentially disposed around the first annular element; and the second annular element is coupled to the base element; and the input device is configured to generate the one or more input signals based on a position of the second annular element.

17. The system of claim 15, wherein the controller includes one or more processors, one or more databases, and one or more non-transitory memory modules communicatively coupled to the one or more processors and storing machine-readable instructions that, when executed, cause the one or more processors to perform at least the following:

receive a first input signal of the one or more input signals, wherein the first input signal corresponds to the position of the first annular element;

receive a second input signal of the one or more input signals, wherein the second input signal corresponds to the pivotal movement of the shaft element;

determine the operation mode of the wheelchair based on the first input signal and the second input signal; and set the wheelchair to the determined operation mode.

18. The system of claim 17, wherein the one or more non-transitory memory modules further comprise machine-readable instructions that, when executed, cause the one or more processors to perform at least the following:

receive a third input signal from a second annular element of the one or more annular elements, wherein the third input signal corresponds to a position of the second annular element; and determine the operation mode of the wheelchair based on the third input signal.

* * * * *